US008556486B2

(12) United States Patent
Chen

(10) Patent No.: US 8,556,486 B2
(45) Date of Patent: Oct. 15, 2013

(54) LIGHT SOURCE ASSEMBLY MECHANISM FOR LED LAMPS

(75) Inventor: Yu-Wen Chen, Tainan (TW)

(73) Assignee: Green Lighting Technology, Corp, Tainan (TW)

( * ) Notice: Subject to any disclaimer, the term of this patent is extended or adjusted under 35 U.S.C. 154(b) by 250 days.

(21) Appl. No.: 13/112,525

(22) Filed: May 20, 2011

(65) Prior Publication Data

US 2011/0286208 A1 Nov. 24, 2011

(30) Foreign Application Priority Data

May 24, 2010 (TW) ..... 99209699 U

(51) Int. Cl.
*F21V 5/00* (2006.01)

(52) U.S. Cl.
USPC ..... 362/581; 362/551

(58) Field of Classification Search
USPC ..... 362/551–582
See application file for complete search history.

(56) References Cited

U.S. PATENT DOCUMENTS 2,302,076 A * 11/1942 Van Loo ..... 362/386
2007/0109501 A1* 5/2007 Imade ..... 353/31

* cited by examiner

*Primary Examiner* — William Carter
(74) *Attorney, Agent, or Firm* — Muncy, Geissler, Olds & Lower, PLLC

(57) ABSTRACT

A light source assembly mechanism includes two sets installed at two ends of an LED lamp tube. Each light source assembly mechanism includes a base, a lamp tube side cap, a turning module side cap and a turning rod. The lamp tube side cap has one side fastened to one end of the LED lamp tube and another side running through the base via a fastening portion to fasten to a coupling portion formed on the turning module side cap. The turning rod runs through the turning module side cap to fasten to the lamp tube side cap. With the same modular elements used at two sides of the LED lamp tube, mold development cost can be reduced, and assembly processes can be simplified. Through turning the turning rod, illumination angle of the LED lamp tube can be adjusted to meet illumination requirements.

6 Claims, 7 Drawing Sheets

LIGHT SOURCE ASSEMBLY MECHANISM FOR LED LAMPS

FIELD OF THE INVENTION

The present invention relates to an LED lamp light source and particularly to a light source assembly mechanism for an LED lamp.

BACKGROUND OF THE INVENTION

LED lamp light source provides many advantages in comparison with the traditional fluorescent lamp light source, such as power saving, greater illumination, higher efficiency and lower temperature and the like, and thus it gradually replaces the traditional fluorescent lamp and becomes the mainstream of illuminated light source.

However, the LED lamp tube replacing the traditional fluorescent lamp used for direct illumination, indirect illumination and illumination in low temperature does not have modular design. As a result, mold development cost is higher, component composition is complex, and production cost is also higher. All these make product prices too high, and hence product popularity suffers.

Moreover, the conventional LED lamp tube has a narrower light emission angle and unadjustable emission direction that limit its utilization. In addition, during assembly of the conventional LED lamp, it generally is fastened by screws. Assembly flexibility is lower and more time-consuming, thus cannot meet use requirements.

SUMMARY OF THE INVENTION

Therefore, the primary object of the present invention is to provide a light source assembly mechanism for an LED lamp that adopts modular design, can change light illumination angle and facilitate assembly, thus better meet use requirements.

To achieve the aforesaid object, the light source assembly mechanism according to the invention is installed at one end of an LED lamp tube and includes a base, a lamp tube side cap, a turning module side cap and a turning rod. The base has a housing chamber communicating with two opposite sides thereof, and a first opening and a second opening at the two opposite sides thereof. The lamp tube side cap has one side fastened to one end of the LED lamp tube and another side covering the first opening and formed a fastening portion which is held in the housing chamber. The turning module side cap covers the second opening and has a coupling portion extended into the housing chamber to fasten to the fastening portion. The turning rod runs through the turning module side cap and is fastened to the lamp tube side cap.

In addition, the base has a holding plate, a magnet and a latch bracket on the surface thereof. The holding plate has at least one fastening hole and is inserted into the latch bracket. The magnet also is inserted into the latch bracket.

By means of the structure set forth above, the same modular elements can be used at two sides of the LED lamp tube. The LED lamp tube can be turned through the turning rod to adjust the illumination angle of the LED lamp tube. The LED lamp tube can be fastened to a board made of any types of materials through the fastening hole, or attracted to a board made of ferromagnetic metal through the magnet.

Compared with the conventional techniques, the present invention provides many advantages, notably:

1. The invention adopts modular design, and hence it can save mold development cost, reduce the numbers of components, simplify assembly processes to lower production cost.

2. The invention provides the turning mechanism to resolve the drawback of narrower light emission angle and direct the light to wherever needed.

3. The invention provides dual fastening design via the magnet and screw. Aside from being attracted to the board made of ferromagnetic metal, the invention also can be fastened to the board made of non-ferromagnetic metal via the screw.

The foregoing, as well as additional objects, features and advantages of the invention will be more readily apparent from the following detailed description, which proceeds with reference to the accompanying embodiments and drawings. The embodiments serve merely for illustrative purpose and are not the limitation of the invention.

DETAILED DESCRIPTION OF THE PREFERRED EMBODIMENTS

Figure 1:
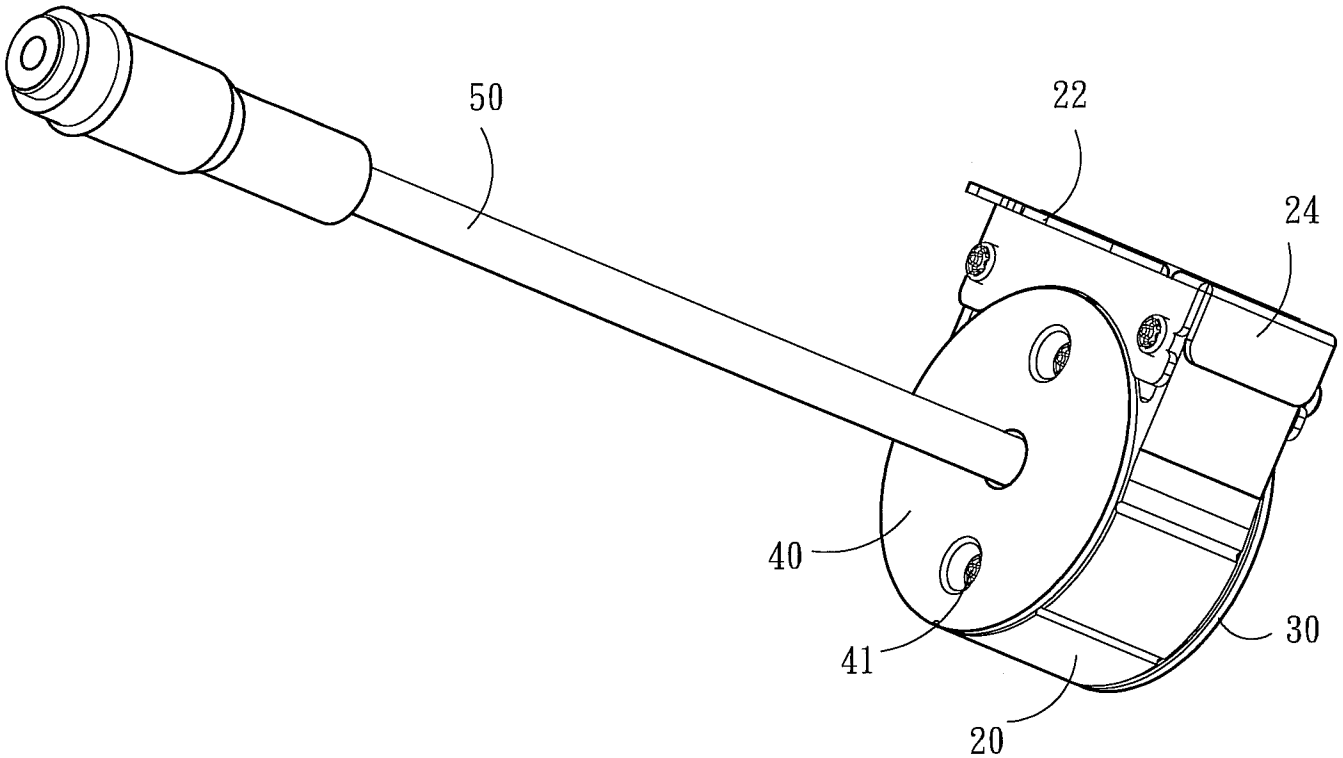
FIG. 1 is a perspective view of the invention.
Figure 2:
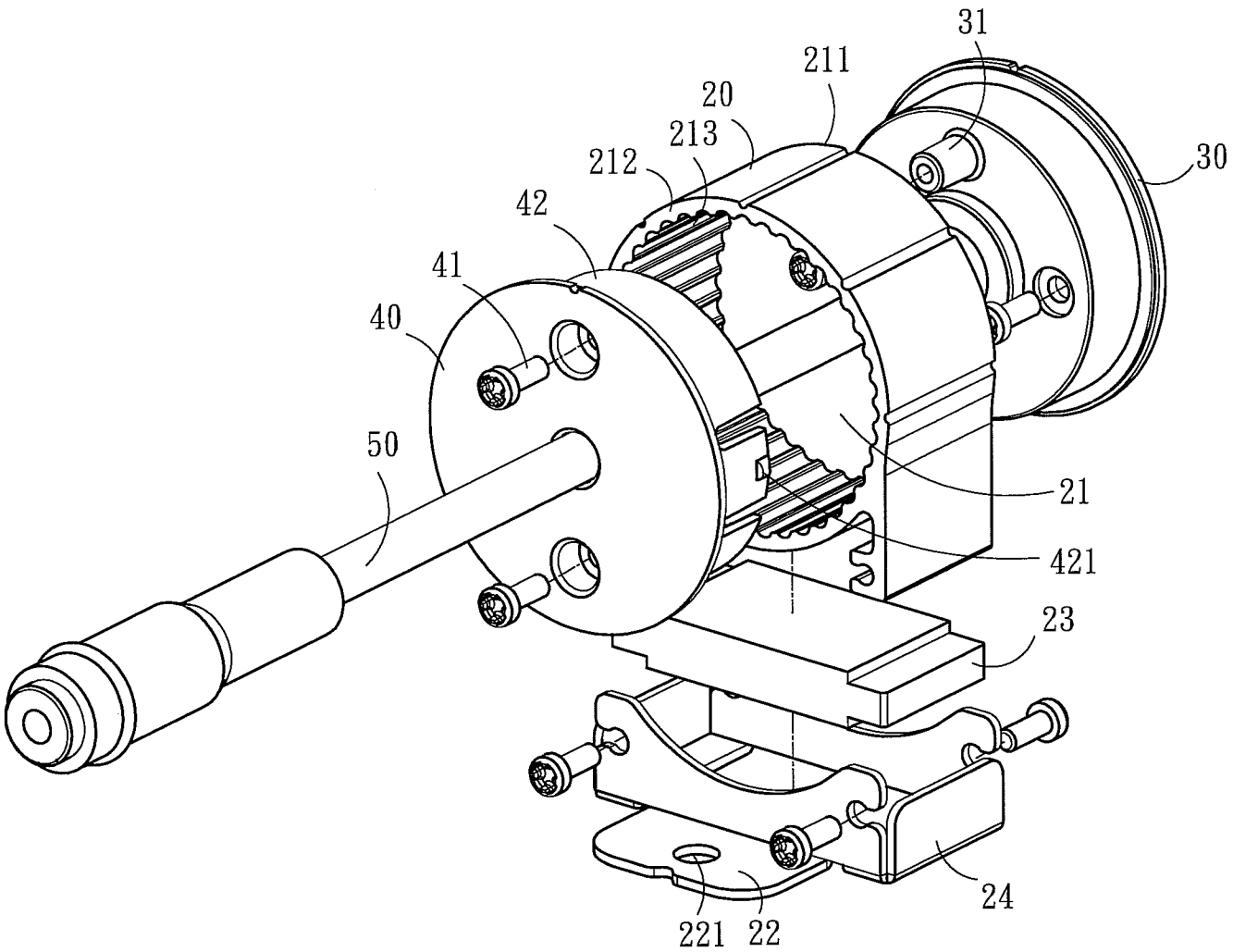
FIG. 2 is an exploded view of the invention.
Figure 3:
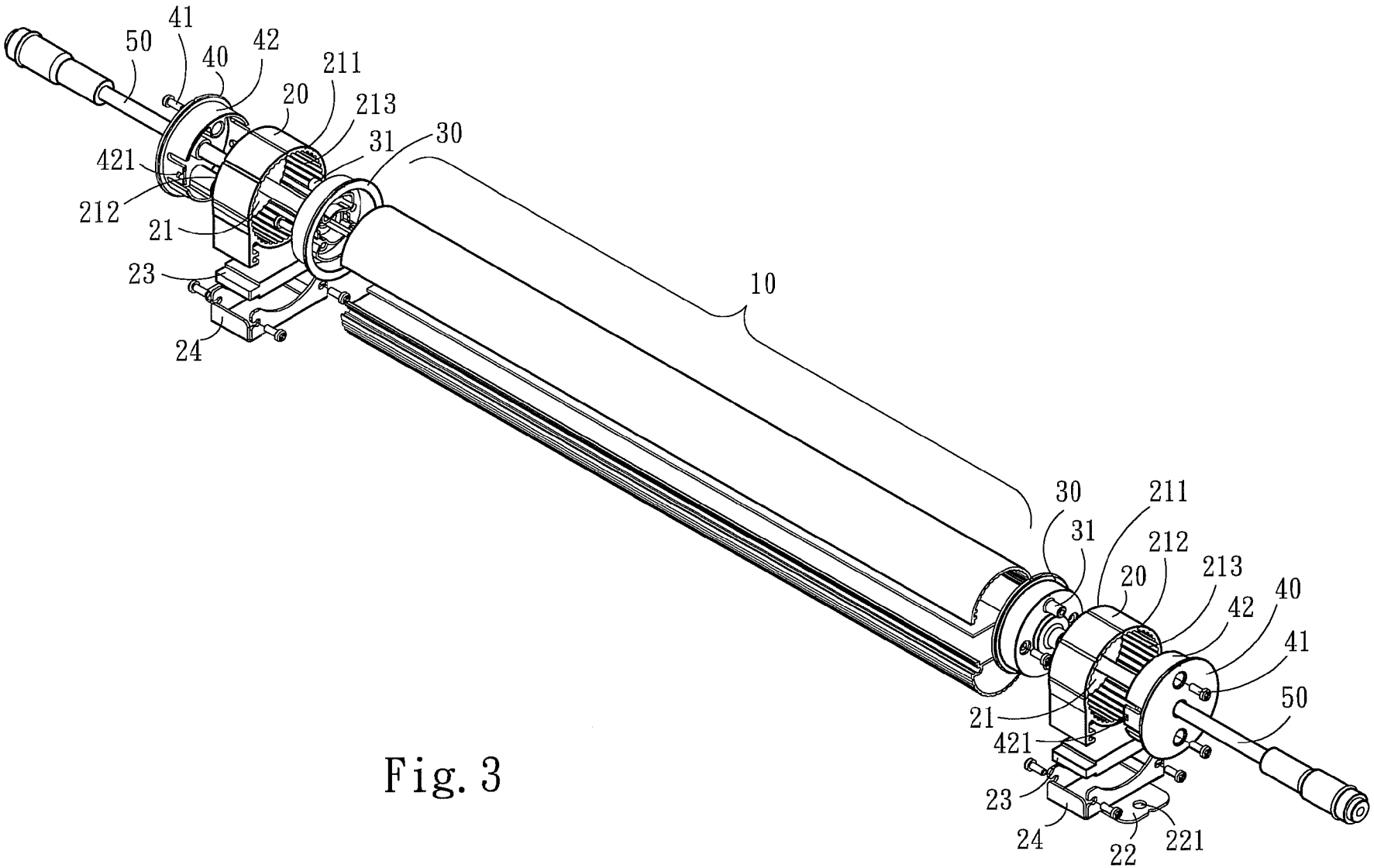
FIG. 3 is an exploded view of the invention in an assembly condition.

Please refer to FIGS. 1, 2 and 3, the present invention aims to provide a light source assembly mechanism which is installed at one end of an LED lamp tube 10. The light source assembly mechanism of the invention includes a base 20, a lamp tube side cap 30, a turning module side cap 40, and a turning rod 50. The base 20 has a housing chamber 21 formed in a cylindrical shape and communicating with two opposite sides thereof, and a first opening 211 and a second opening 212 at the two opposite sides thereof.

The lamp tube side cap 30 has one side fastened to one end of the LED lamp tube 10 and another side covering the first opening 211 and formed a fastening portion 31 which is held in the housing chamber 21. The turning module side cap 40 covers the second opening 212 and has a coupling portion 41 extended into the housing chamber 21 to fasten to the fastening portion 31. The turning rod 50 runs through the turning module side cap 40 and is fastened to the lamp tube side cap 30. The turning module side cap 40 has a coupling ring 42 extended axially into the second opening 212 and coupled tightly in the housing chamber 21. The housing chamber 21 has a continuous undulant surface 213 formed annularly at an inner side thereof. The coupling ring 42 has a bump 421 corresponding to the undulant surface 213.

The base 20 has a holding plate 22 with at least one fastening hole 221 formed thereon, and also has a magnet 23 and a latch bracket 24 on the surface thereof. The holding plate 22 and magnet 23 are inserted into the latch bracket 24.

Figure 4A:
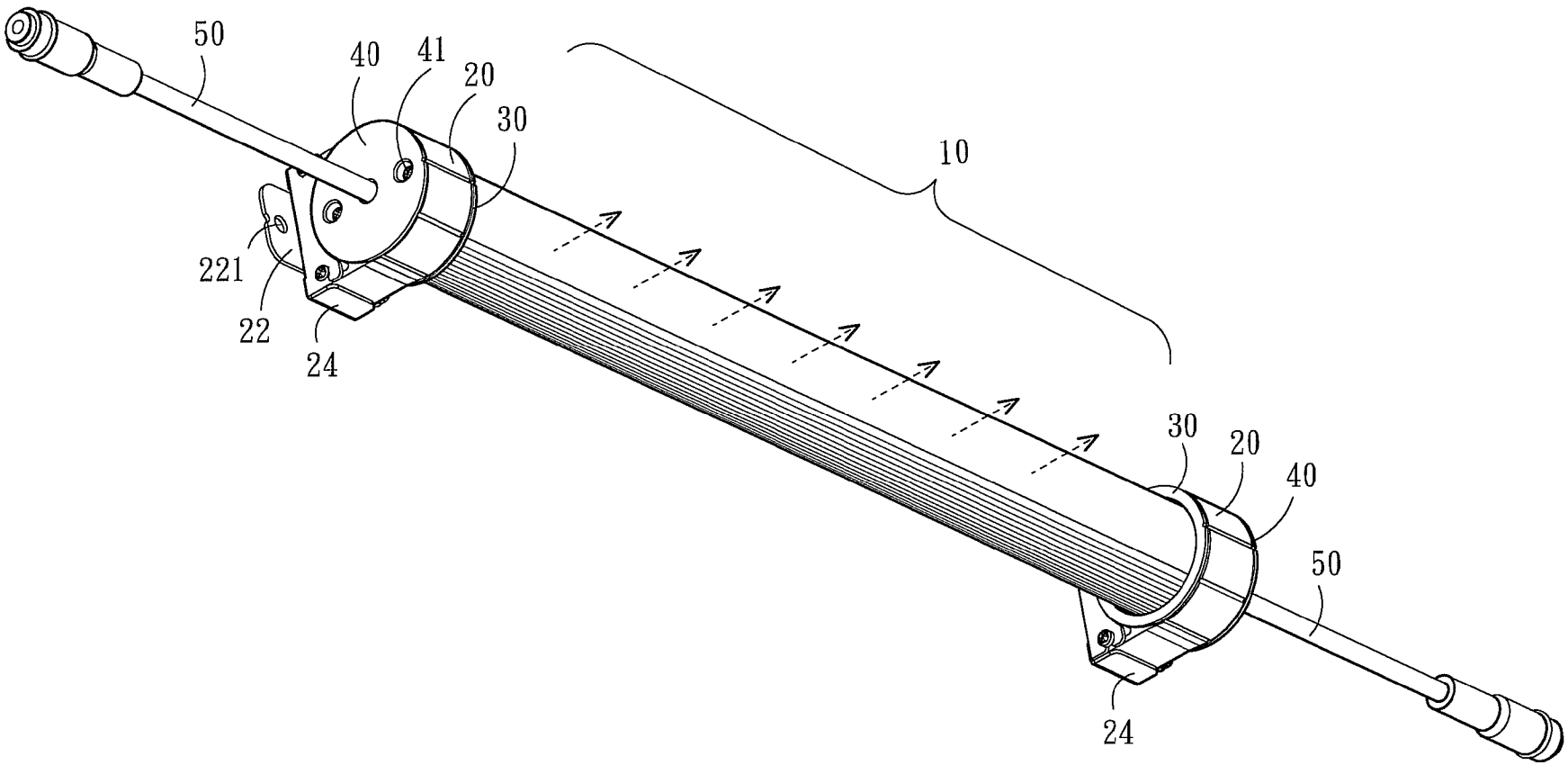
FIG. 4A is a schematic view of the invention showing the LED lamp tube turned at one angle.
Figure 4B:
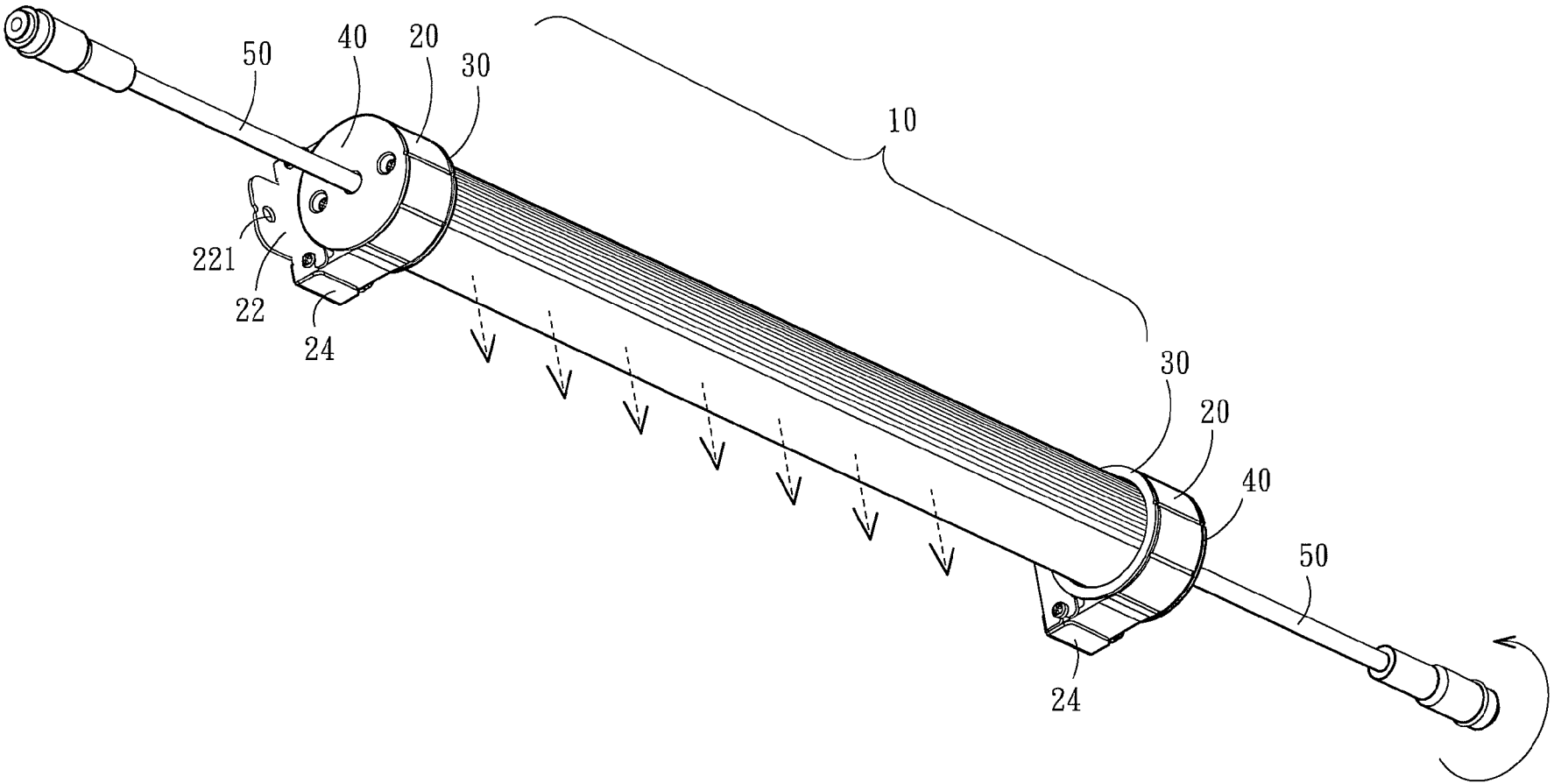
FIG. 4B is a schematic view of the invention showing the LED lamp tube turned at another angle.

Please refer to FIGS. 4A and 4B for the LED lamp tube 10 emitting light in varying angles. Through turning the turning rod 50, the LED lamp tube 10 can be adjusted to a desired illumination angle. The frictional force caused by tight coupling between the coupling ring 42 and the housing chamber 21, and latching between the undulant surface 213 and the bump 421 can be also used to adjust and hold the LED lamp tube 10 at a desired angle.

Figure 5:
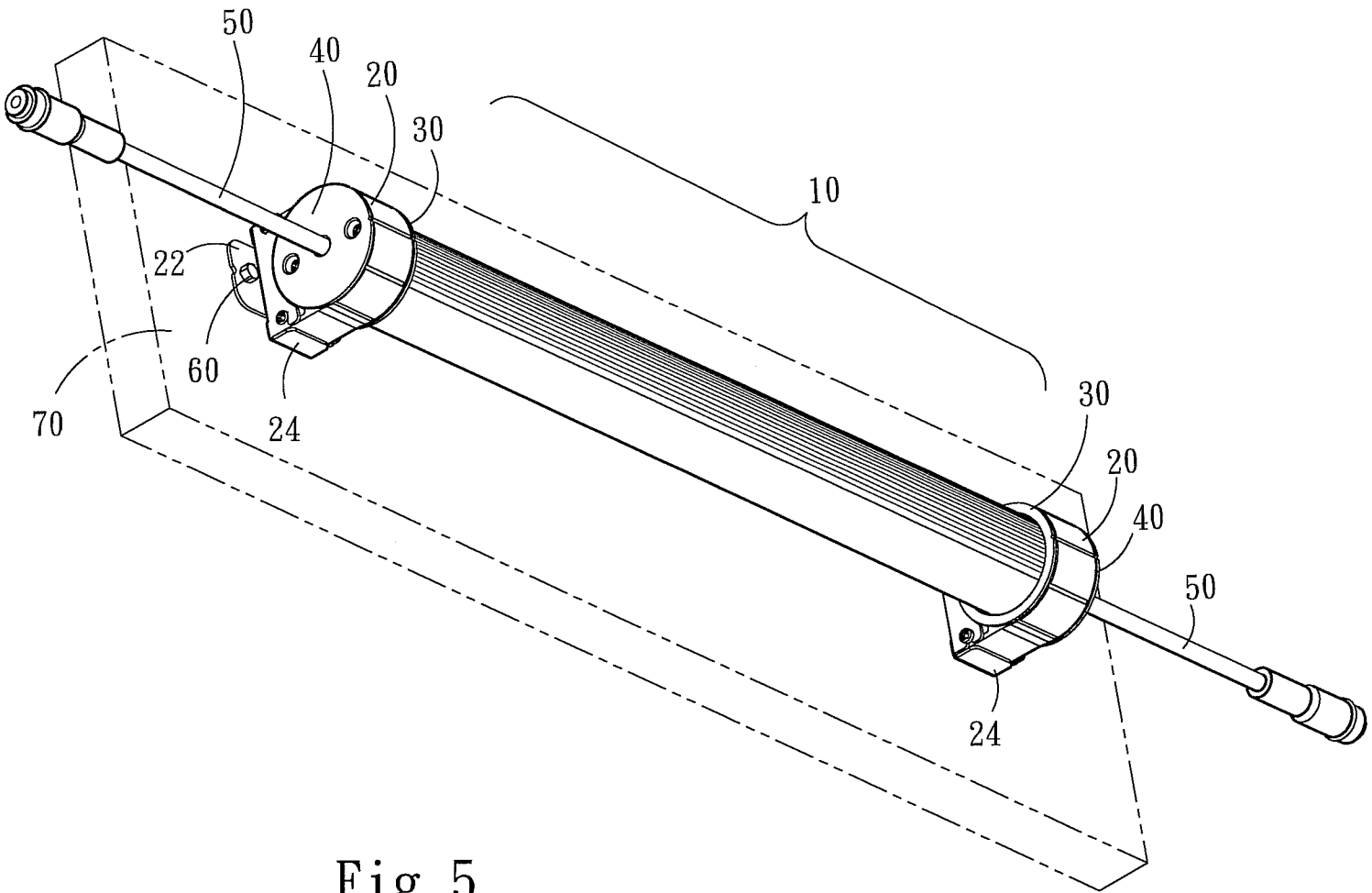
FIG. 5 is a schematic view of the invention fastened to a board.
Figure 6:
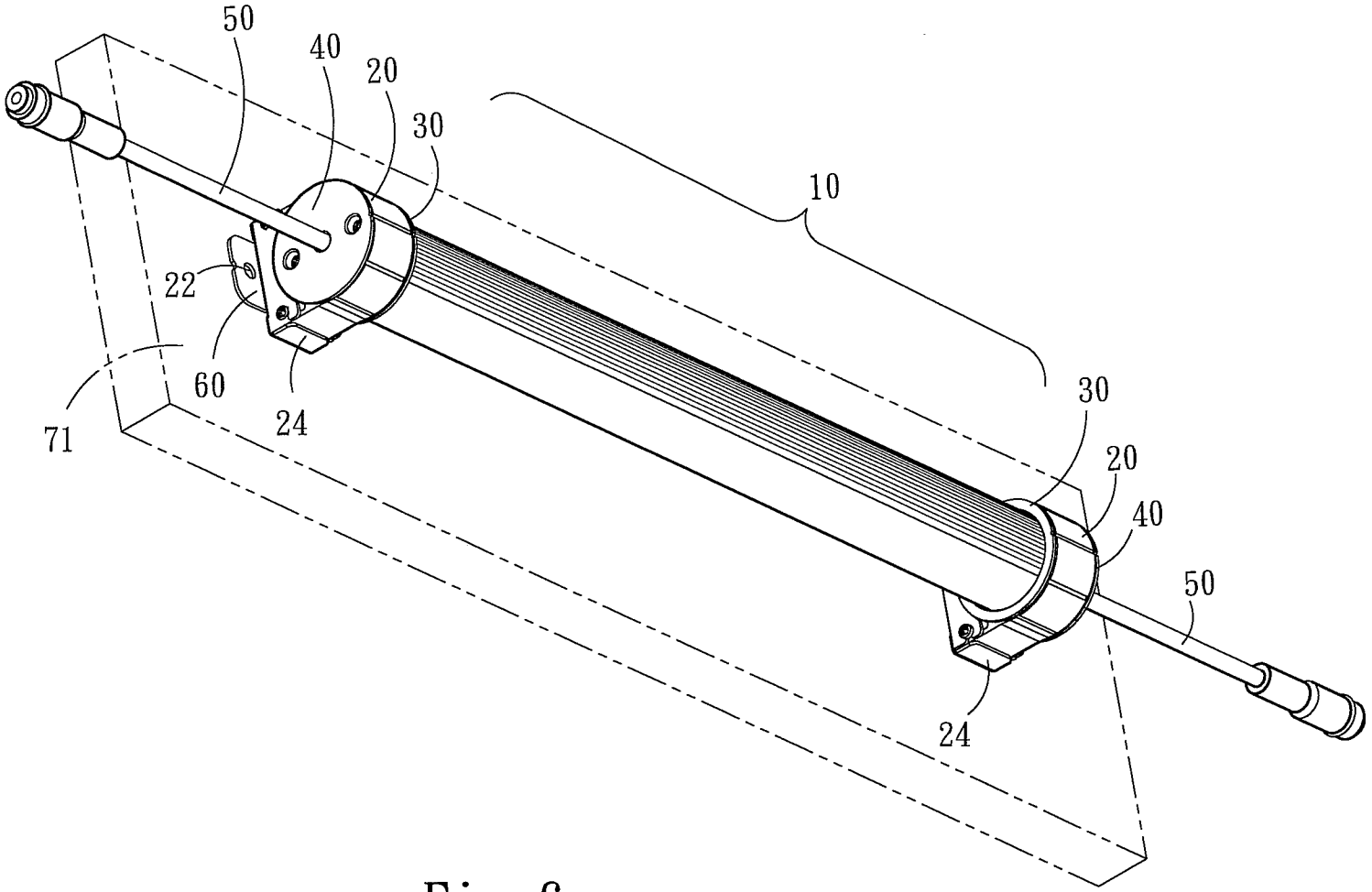
FIG. 6 is a schematic view of the invention fastened to another type of board.

Refer to FIGS. 5 and 6 for fastening the LED lamp tube 10 onto the board 70 and 71. The LED lamp tube 10 can be fastened to a board 70 made of any material through a screw 60, such as the board 70 is made of rubber (referring to FIG. 5). The LED lamp tube 10 also can be attracted to the board 71 made of ferromagnetic metal through a magnet 23 (referring to FIG. 6). Thus the invention is applicable to the board 70 or 71 made of varying types of materials.

In short, the present invention provides a modular design, and the LED lamp tube 10 can be turned as desired. It also provides multiple assembly means. Thus mold development cost can be saved, the numbers of elements can be reduced, and assembly processes can be simplified to decrease production cost. The LED light source can emit light to be projected to wherever desired, and it also can be widely installed to the board 70 or 71 made of any types of materials to better meet use requirements.

What is claimed is:

1. A light source assembly mechanism installed at one end of an LED lamp tube, comprising:

a base which includes a housing chamber communicating with two opposite sides thereof, and a first opening and a second opening at the two opposite sides thereof;

a lamp tube side cap which includes one side fastened to the one end of the LED lamp tube and another side covering the first opening and formed a fastening portion held in the housing chamber;

a turning module side cap which covers the second opening and includes a coupling portion extended into the housing chamber to fasten to the fastening portion; and a turning rod running through the turning module side cap and fastened to lamp tube side cap, wherein the housing chamber is formed in a cylindrical shape, and the turning module side cap includes a coupling ring extended axially into the second opening and coupled tightly in the housing chamber.

2. The light source assembly mechanism of claim 1, wherein the housing chamber includes a continuous undulant surface formed annularly in an inner side thereof, the coupling ring including a bump corresponding to the undulant surface.

3. The light source assembly mechanism of claim 1, wherein the base includes a holding plate with at least one fastening hole formed thereon.

4. The light source assembly mechanism of claim 3, wherein the base includes a latch bracket inserted by the holding plate.

5. The light source assembly mechanism of claim 1, wherein the base includes a magnet.

6. The light source assembly mechanism of claim 5, wherein the base includes a latch bracket inserted by the magnet.

* * * * *